US010252529B2

(12) United States Patent
Hirai et al.

(10) Patent No.: US 10,252,529 B2
(45) **Date of Patent: *Apr. 9, 2019**

(54) PRINTER

(71) Applicant: BROTHER KOGYO KABUSHIKI KAISHA, Nagoya-shi, Aichi-ken (JP)

(72) Inventors: Keita Hirai, Nagoya (JP); Shohei Koide, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/838,681

(22) Filed: Dec. 12, 2017

(65) Prior Publication Data

US 2018/0194137 A1 Jul. 12, 2018

Related U.S. Application Data

(63) Continuation of application No. 15/426,494, filed on Feb. 7, 2017, now Pat. No. 9,868,285.

(30) Foreign Application Priority Data

Mar. 31, 2016 (JP) ..... 2016-070089

(51) Int. Cl.
*B41J 2/14* (2006.01)
*B41J 2/155* (2006.01)
(Continued)

(52) U.S. Cl.
CPC ..... *B41J 2/155* (2013.01); *B41J 2/145* (2013.01); *B41J 2/1433* (2013.01); *B41J 2/15* (2013.01);
(Continued)

(58) Field of Classification Search
CPC ... B41J 2/1433; B41J 2/145; B41J 2/01; B41J 2/15; B41J 2/155; B41J 2/16;
(Continued)

(56) References Cited

U.S. PATENT DOCUMENTS 4,198,642 A * 4/1980 Gamblin ..... B41J 2/5056 347/41
6,467,870 B2 10/2002 Matsumoto et al.
6,595,614 B2 * 7/2003 Morikawa ..... B41J 2/15 347/15
6,812,953 B2 * 11/2004 Peterson ..... B41J 2/2103 347/12
(Continued)

FOREIGN PATENT DOCUMENTS

JP 2015-150824 A 8/2015
JP 2015-189183 A 11/2015
(Continued)

OTHER PUBLICATIONS

Notice of Allowance dated Sep. 7, 2017 from parent U.S. Appl. No. 15/426,494.

*Primary Examiner* — Anh T. N. Vo
(74) *Attorney, Agent, or Firm* — Scully, Scott, Murphy & Presser, PC

(57) ABSTRACT

There is provided a printer including first to fourth head chips, and first and second rollers. The first to fourth head chips are arranged at intervals in a second direction orthogonal to a first direction. A nozzle, of nozzles arranged in a second head chip N and used for printing, which is positioned closest to the one side in the second direction is referred to as a nozzle A. A nozzle, of nozzles arranged in a fourth head chip N and used for printing, which is positioned closest to the one side in the second direction is referred to as a nozzle B. The nozzle A is arranged closer to the one side in the second direction than the nozzle B and the first roller is arranged closer to the other side in the second direction than the second roller.

12 Claims, 10 Drawing Sheets

(51) Int. Cl.

| | |
|---|---|
| ***B41J 2/145*** | (2006.01) |
| ***B41J 2/15*** | (2006.01) |
| ***B41J 2/16*** | (2006.01) |
| ***B41J 2/515*** | (2006.01) |
| ***B41J 2/21*** | (2006.01) |
| ***B41J 25/308*** | (2006.01) |

(52) U.S. Cl.
CPC ..... *B41J 2/16* (2013.01); *B41J 2/2146* (2013.01); *B41J 2/515* (2013.01); *B41J 25/3084* (2013.01); *B41J 2002/14467* (2013.01)

(58) Field of Classification Search
CPC ..... B41J 2/2146; B41J 2/515; B41J 25/3084; B41J 2002/14467
See application file for complete search history.

(56) References Cited

U.S. PATENT DOCUMENTS

| | | | | |
|---|---|---|---|---|
| 6,846,062 | B2 | 1/2005 | Yamane | |
| 7,441,854 | B2 | 10/2008 | Jahana et al. | |
| 7,517,052 | B2 | 4/2009 | Wada et al. | |
| 8,413,327 | B2 | 4/2013 | Matsumoto et al. | |
| 8,517,513 | B2 * | 8/2013 | Fang | B41J 2/14072 347/40 |
| 9,150,013 | B2 * | 10/2015 | Somete | B41J 2/04588 |
| 9,868,285 | B2 * | 1/2018 | Hirai | B41J 2/1433 |
| 2015/0231880 | A1 | 8/2015 | Nagase et al. | |
| 2015/0273907 | A1 | 10/2015 | Takino et al. | |

FOREIGN PATENT DOCUMENTS

| | | | |
|---|---|---|---|
| JP | 2015-189184 | A | 11/2015 |
| JP | 2015-231721 | A | 12/2015 |

* cited by examiner

PRINTER

CROSS REFERENCE TO RELATED APPLICATION

The present application is a continuation application of U.S. Ser. No. 15/426,494 filed on Feb. 7, 2017 and claims priority from Japanese Patent Application No. 2016-070089 filed on Mar. 31, 2016, the disclosures of each of which are incorporated herein by reference in their entirety.

BACKGROUND

Field of the Invention

The present invention relates to a printer.

Description of the Related Art

As a printer, there is conventionally known a line-type jetting head including head chips arranged in a width direction of a recording medium. In such a jetting head, two head chips are adjacent to each other in the width direction of the recording medium and deviate from each other in a conveyance direction of the recording medium. Further, ends of the two head chips are arrayed in the conveyance direction of the recording medium.

In an area, of the jetting head, in which the two adjacent head chips face each other in the conveyance direction, nozzles of the two head chips are used selectively in a predefined boundary position. In that case, if the two head chips differ in jetting characteristics, landing deviations of ink jetted from the two head chips occur, resulting in streak-like density unevenness.

As a means of solving the above problem, there is conventionally known a printer in which an area where two head chips face each other in a conveyance direction is divided into a section for jetting ink from only one of the two head chips, a section for jetting ink from only the other of the two head chips, and a section for jetting ink from both of the two head chips. In the following, for easy explanation, each nozzle which is arranged at a boundary of the section where both of the two head chips are used in the area where the two head chips face each other in the conveyance direction is referred to as a "boundary nozzle". In an area for which printing is performed with the boundary nozzles, droplets of ink jetted from nozzles of the respective two head chips land in a dispersed or scattered state. This prevents density unevenness which would be otherwise caused by the difference in jetting characteristics of nozzles between the respective two head chips.

Another publicly known printer has a jetting head in which four head chips are arranged zigzag, wherein each roller pressing a recording medium during printing is provided between the head chips. Namely, each roller is arranged at a position next to one of two adjacent head chips in a width direction of the recording medium and facing the other of the two adjacent head chips in a conveyance direction of the recording medium.

SUMMARY

Although the former printer has the section where ink is jetted from nozzles of both of the two head chips, density unevenness of an image part formed by using nozzles of this section is still conspicuous, as compared to density unevenness of an image part formed by nozzles of a single head chip.

Thus, in a printer in which the above-described jetting heads arranged in the conveyance direction, if positions of boundary nozzles in a nozzle arrangement direction are the same between the jetting heads, printing quality might deteriorate.

Further, in order to prevent image deterioration due to gap variation between the jetting head and the recording medium, each roller pressing the recording medium is preferably arranged as close to an end of the head chip as possible in the vicinity of boundary nozzles causing density unevenness easily. However, if positions of the rollers in the nozzle arrangement direction are the same between the jetting heads by arranging each roller close to an end of the head chip for all of the jetting heads, each of the rollers sequentially presses the same position of the recording medium, which results in conspicuous roller marks on the recording medium.

Thus, it is desired that the boundary nozzles of the head chips and the rollers be optimally arranged in the two jetting heads to reduce roller marks and density unevenness in an image part for which printing is performed with the boundary nozzles.

An object of the present teaching is to prevent, in a configuration in which head chip groups are arranged to partially face each other in a conveyance direction of a recording medium, overlap of roller marks and overlap of density unevenness due to boundary nozzles of the head chip groups.

According to an aspect of the present teaching, there is provided a printer configured to perform printing on a recording medium, including:

first head chips corresponding to a first ink and arrayed at intervals in a second direction orthogonal to a first direction in which the recording medium is conveyed;

second head chips corresponding to the first ink and arrayed at intervals in the second direction at positions which are different from arrangement positions of the first head chips in the second direction and are adjacent to arrangement positions of the first head chips in the first direction;

third head chips corresponding to a second ink and arrayed at intervals in the second direction at positions respectively corresponding to the arrangement positions of the first head chips in the second direction;

fourth head chips corresponding to the second ink and arrayed at intervals in the second direction at positions which respectively correspond to arrangement positions of the second head chips in the second direction and are adjacent to arrangement positions of the third head chips in the first direction;

a first roller arranged to face one of the first head chips in the first direction on one side of a second head chip N in the second direction, the second head chip N being a N-th second head chip of the second head chips counted from the one side in the second direction; and a second roller arranged to face one of the third head chips in the first direction on one side of a fourth head chip N in the second direction, the fourth head chip N being an N-th fourth head chip of the fourth head chips counted from the one side in the second direction, wherein, when it is assumed that a nozzle, of nozzles arranged in the second head chip N and used for printing, which is positioned closest to the one side in the second direction is referred to as a nozzle A and that a nozzle, of nozzles arranged in the fourth head chip N and used for printing, which is positioned closest to the one side in the second direction is referred to as a nozzle B, the nozzle A is arranged closer to the one side in the second direction than the nozzle B and the first roller is arranged closer to the other side in the second direction than the second roller.

In the present teaching, the position, of the first roller provided for a head chip group (first and second head chips) corresponding to the first ink, in the second direction is different from the position, of the second roller provided for a head chip group (third and fourth chips) corresponding to the second ink, in the second direction. This reduces roller marks in the recording medium.

In typical head chips, an end nozzle of one of the head chips to be used for printing has density unevenness easily due to ink landing deviations between ink droplets from the end nozzle and ink droplets from nozzles of another head chip that partially faces the head chip having the end nozzle in a conveyance direction. In the present teaching, however, the nozzle A, of nozzles arranged in the second head chip N and used for printing, which is positioned closest to the one side in the second direction and the nozzle B, of nozzles arranged in the fourth head chip N and used for printing, which is positioned closest to the one side in the second direction have mutually different positions in the second direction. Thus, the present teaching prevents deterioration of image quality which would be otherwise caused by overlap of image density unevenness due to the end nozzles of different head chip groups.

The nozzle A arranged at the end of the second head chip N and used for printing is positioned closer to the end side in the second direction than the nozzle B arranged at the end of the fourth head chip N and used for printing. Further, the first roller corresponding to the second head chip N is arranged close to the nozzle A. Thus, the distance between the nozzle A arranged at the end of the second head chip N and used for printing and the first roller is shorter than the distance between the nozzle B arranged at the end of the fourth head chip N and used for printing and the second roller.

In a typical boundary nozzle group which may cause density unevenness, if a gap between each head chip and the recording medium varies, the density unevenness could be more conspicuous. Thus, a roller pressing the recording medium is preferably arranged close to the boundary nozzle group. In a configuration in which the head chip groups have mutually different positions of the boundary nozzle groups and mutually different positions of the rollers, however, it may be difficult to arrange the rollers close to the boundary nozzle groups. Thus, in the present teaching, the first roller is arranged close to the boundary nozzle group in each of the first and second head chips corresponding to the first ink, and the second roller is arranged distant from the boundary nozzle group in each of the third and fourth head chips corresponding to the second ink.

DESCRIPTION OF THE EMBODIMENTS

Figure 1:
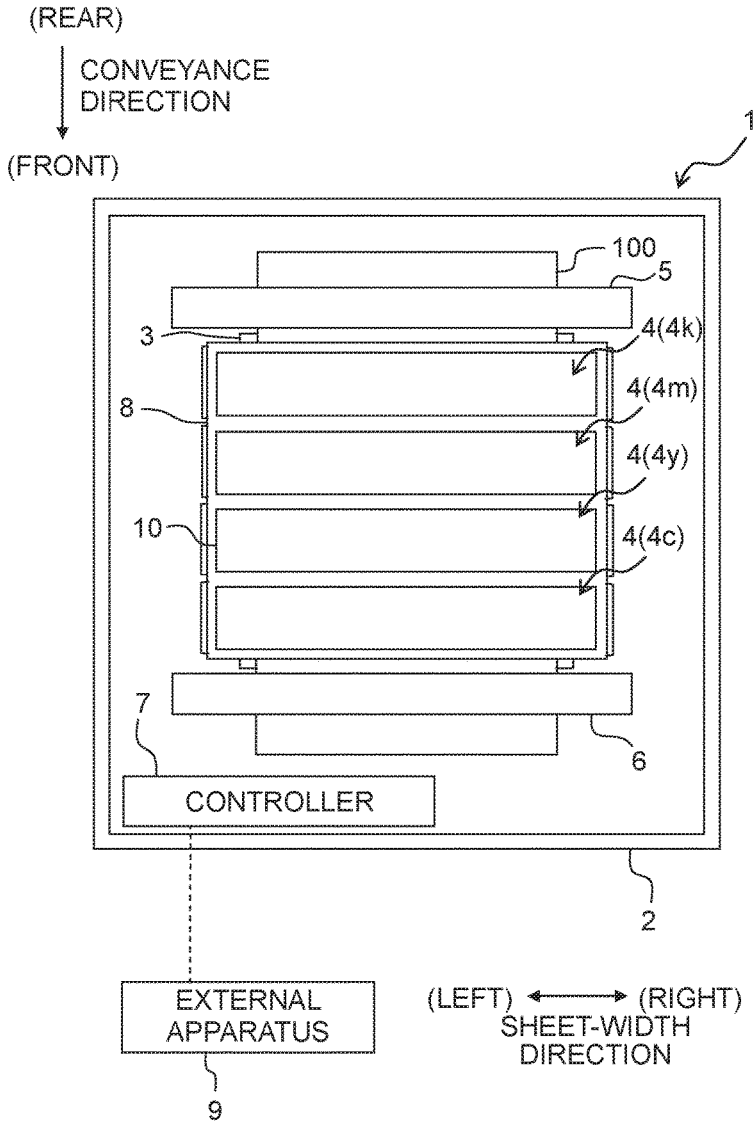
FIG. 1 is a schematic plan view of a printer according to an embodiment of the present teaching.

Subsequently, an embodiment of the present teaching will be described. A conveyance direction in which a recording sheet 100 is conveyed in FIG. 1 is defined as a front-rear direction of a printer 1. A width direction of the recording sheet 100 (hereinafter also referred to as "sheet width direction") is defined as a left-right direction of the printer 1. A direction perpendicular to a paper surface of FIG. 1, i.e., perpendicular to the front-direction and left-right direction, is defined as an up-down direction of the printer 1.

<Schematic Configuration of Printer>

As depicted in FIG. 1, the printer 1 includes a platen 3, four ink-jet heads 4, two conveyance rollers 5 and 6, a controller 7, a roller unit 8, and the like, those of which are contained in a housing 2 of the printer 1.

The recording sheet 100 is placed on an upper surface of the platen 3. The four ink-jet heads 4 are arranged in the conveyance direction above the platen 3. Inks are supplied from unillustrated ink tanks to the respective ink-jet heads 4, and any of four color inks (black, yellow, cyan, and magenta inks) is supplied to the corresponding one of the four ink-jet heads 4. Namely, the four ink-jet heads 4 jet inks having mutually different colors, respectively.

In the following description, configurations corresponding to black, magenta, yellow, and cyan are assigned with alphabetic suffixes of "k" indicating black, "m" indicating magenta, "y" indicating yellow, and "c" indicating cyan, respectively. For example, an ink-jet head 4*k* depicted in FIG. 1 represents the ink-jet head 4 jetting black ink.

The controller 7 includes a Central Processing Unit (CPU), a Read Only Memory (ROM), a Random Access Memory (RAM), and an Application Specific Integrated Circuit (ASIC) including various control circuits. The controller 7 includes a nonvolatile memory storing various control parameters in a rewritable manner The controller 7 is connected in data communication with an external apparatus 9, such as a PC, to control respective parts of the printer 1, such as the four ink-jet heads 4 and a conveyance motor, based on image data sent from the external apparatus 9.

More specifically, the controller 7 controls the conveyance motor driving the conveyance rollers 5 and 6 to convey the recording sheet 100 by use of the two conveyance rollers 5 and 6 in the conveyance direction. In parallel with the sheet conveyance, the controller 7 controls the four ink-jet heads 4 to jet inks to the recording sheet 100. Accordingly, an image is printed on the recording sheet 100.

<Ink-jet Heads and Roller Unit>

Figure 2:
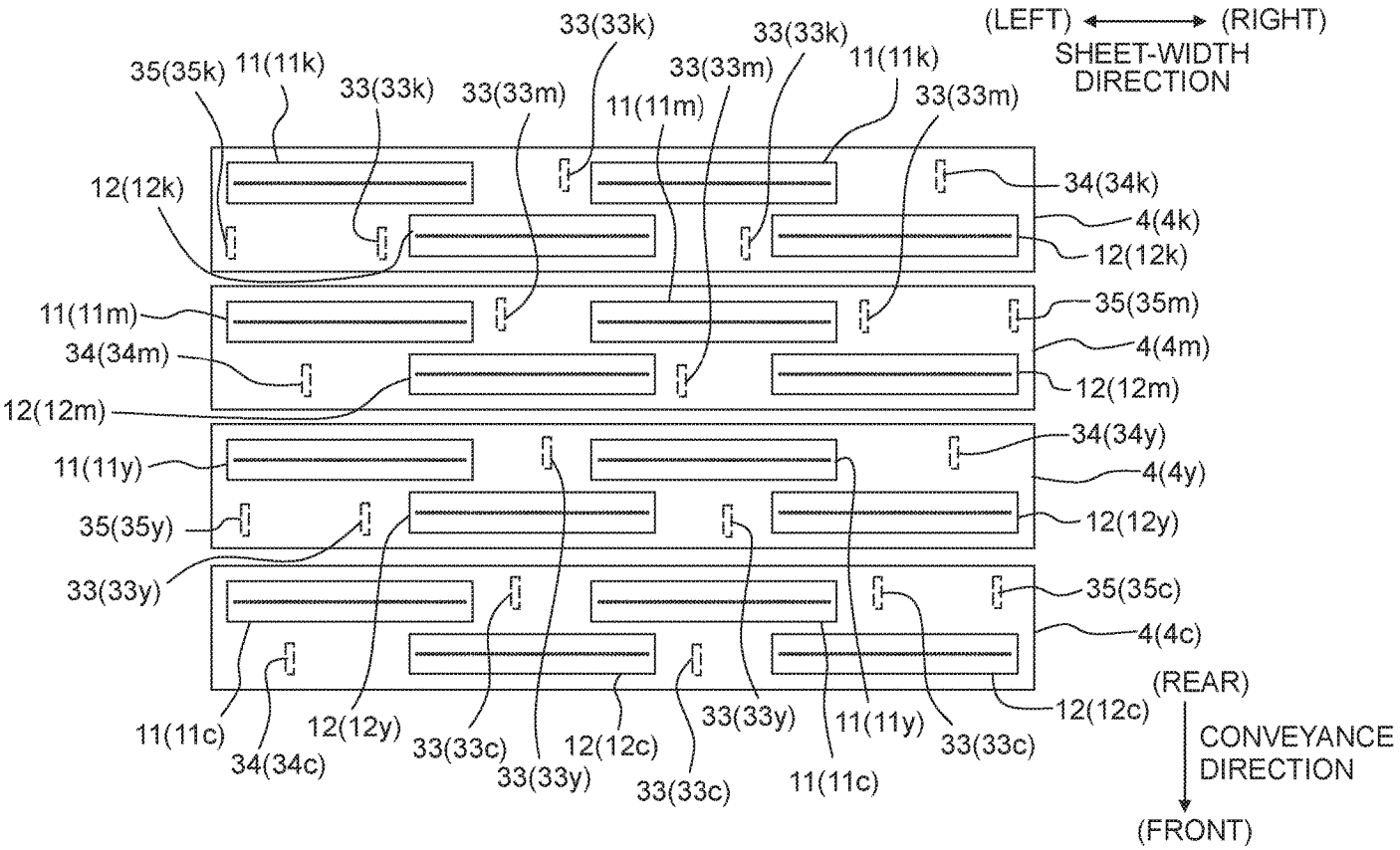
FIG. 2 is a plan view of four ink-jet heads.
Figure 3:
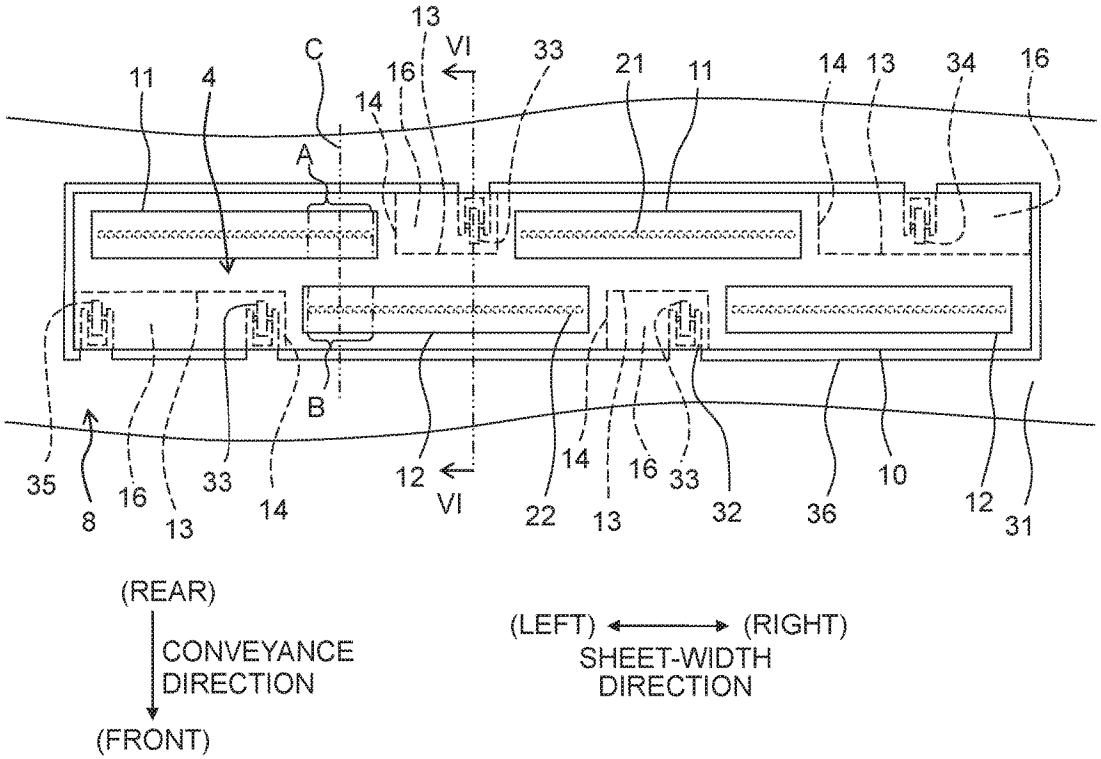
FIG. 3 is a plan view of one of the ink-jet heads and a roller unit.
Figure 6:
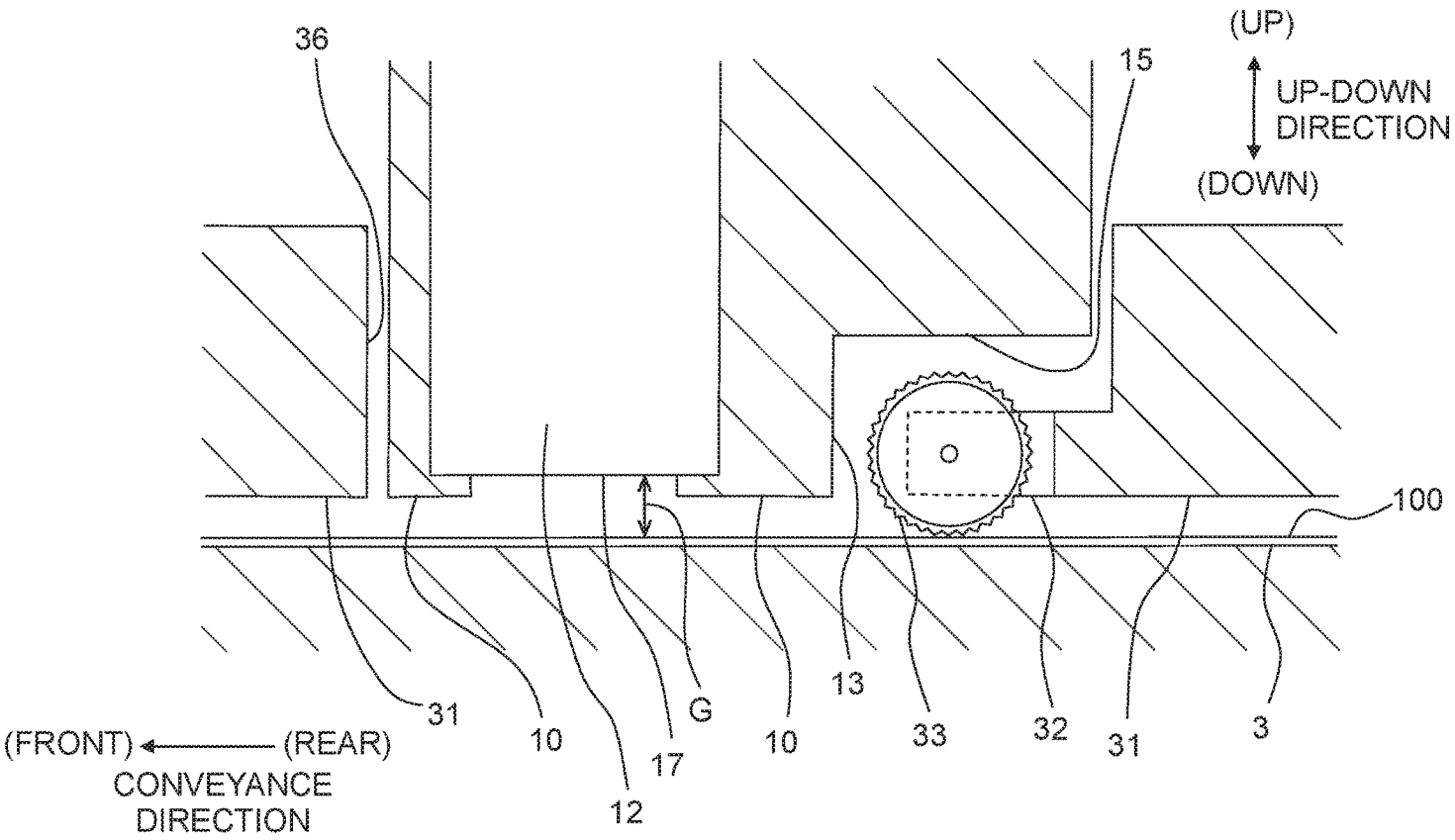
FIG. 6 is a cross-sectional view taken along a line VI-VI in FIG. 3.

As depicted in FIGS. 2, 3, and 6, the four ink-jet heads 4 and a roller unit 8 are arranged above the platen 3. The roller unit 8 has four openings 36 corresponding to the four ink-jet heads 4, respectively. The ink-jet heads 4 are arranged on the roller unit 8. The ink-jet heads 4 may move to separate from the roller unit 8. The ink-jet heads 4 move to positions separate from the roller unit 8 in a case of maintenance, such as a purge.

<Ink-jet Heads>

The ink-jet heads 4 will be described first. As depicted in FIG. 2, each of the ink-jet heads 4 includes two head chips 11 arranged with an interval in the left-right direction and two head chips 12 arranged with an interval in the left-right direction. The head chips 11 and 12 are mounted on a chip holding plate 10.

As depicted in FIGS. 3 and 6, notches 16 are formed at parts, of the chip holding plate 10, including no head chips 11 and no head chips 12. Each of the notches 16 is formed by a side surface 13 orthogonal to the front-rear direction, a side surface 14 orthogonal to the left-right direction, and a side surface 15 perpendicular to the up-down direction. Each of the notches 16 accommodates a roller 33 and the like of the roller unit 8.

The head chips 11 and 12 are alternately arranged in the left-right direction in a state of deviating from each other in the conveyance direction. The head chips 11 are arranged on the rear side and the head chips 12 are arranged on the front side in the conveyance direction, as depicted in FIG. 2. Namely, the head chips 11 and 12 are alternately arranged in the left-right direction to form a zigzag shape in which the head chips 11 are arranged on the rear side and the head chips 12 are arranged on the front side in the conveyance direction. Each of the head chips 11 includes nozzles 21 arrayed in the left-right direction, and each of the head chips 12 includes nozzles 22 arrayed in the left-right direction. In the present embodiment, the positions of the head chips 11 and 12 in the left-right direction are the same between the ink-jet heads 4 for the respective ink colors.

An area of the head chip 11 formed with the nozzles 21 and an area, of the head chip 12 adjacent to the head chip 11, formed with the nozzles 22 are positioned to partially face each other in the front-rear direction.

In FIG. 3, a right end area of the leftmost head chip 11 surrounded by a chain line where the nozzles 21 are arranged to face some of the nozzles 22 of the head chip 12 in the front-rear direction is defined as an area A. Further, a left end area, of the head chip 12 arranged immediately on the right of the leftmost head chip 11, surrounded by a chain line where the nozzles 22 are arranged to face the nozzles 21 of the area A of the head chip 11 in the front-rear direction is defined as an area B. The position of the area A is coincident with the position of the area B in the left-right direction, and the position of the nozzles 21 in the area A is coincident with the position of the nozzles 22 in the area B in the left-right direction.

Similarly, regarding any other head chips 11 and 12 arranged adjacent to each other, the head chips 11 and 12 are arranged to partially face each other in the front-rear direction. Arranging the head chips 11 and 12 alternately in the left-right direction in a state of partially facing each other in the front-rear direction forms a single line head in which the nozzles 21 and the nozzle 22 are arranged at regular intervals in the left-right direction.

The controller 7 performs the following jetting control for each of the ink-jet heads 4 configured as described above. For sake of simplicity, the area A of the leftmost head chip 11 and the area B of the head chip 12 arranged immediately on the right of the leftmost head chip 11 will be explained. The same is true on any other head chips 11 and 12.

In the area A of the head chip 11 and the area B of the head chip 12, there are nozzles 21 and 22 configured to be jet ink on the recording sheet 100 from both of the head chip 11 and the head chip 12. The jetting control in the areas A and B will be explained in detail with reference to FIGS. 4 and 5.

Figure 4:
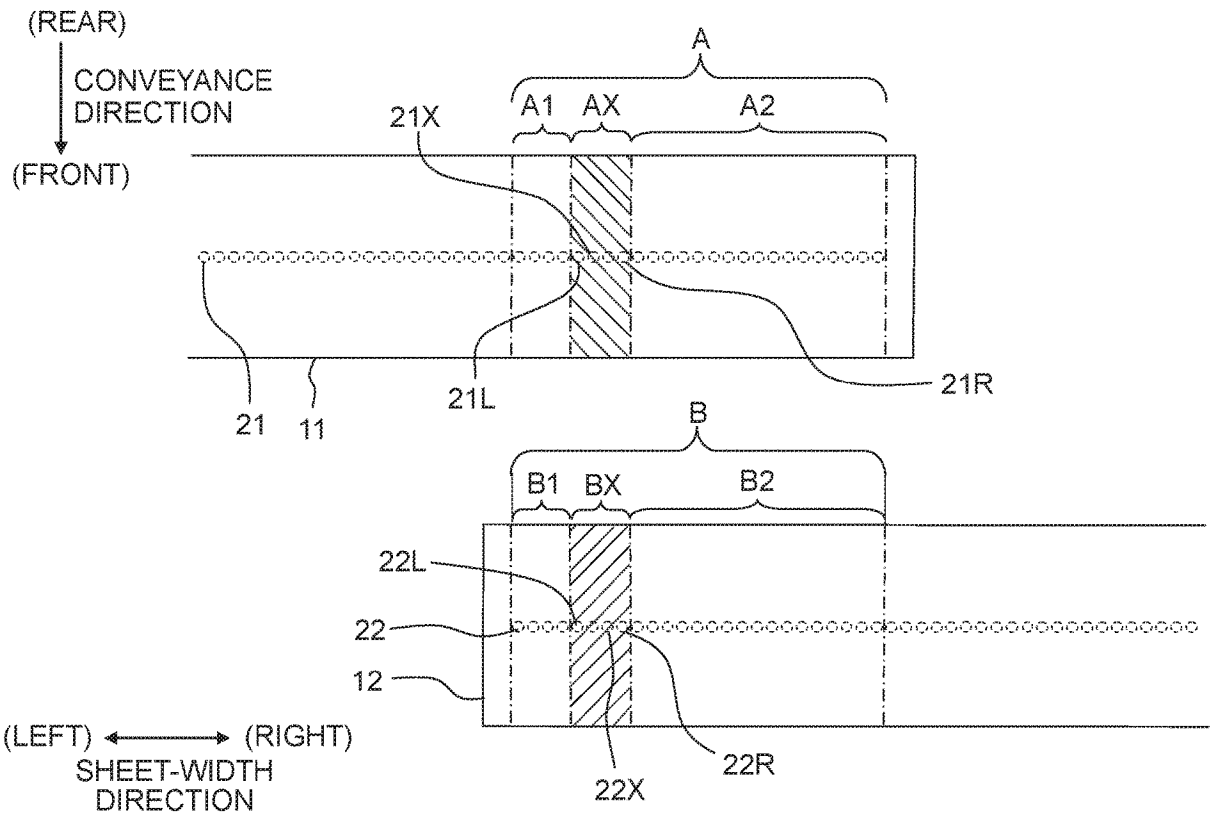
FIG. 4 is an enlarged view of two head chips of one of the ink-jet heads.

In FIG. 4, chain lines divide the area A of the head chip 11 into an area A1 from which ink is jetted, an area AX from which ink is jetted, and an area A2 from which no ink is jetted. The hatched area in FIG. 4 is the area AX. Further, chain lines divide the area B of the head chip 12 into an area B1 from which no ink is jetted, an area BX from which ink is jetted, and an area B2 from which ink is jetted. The hatched area in FIG. 4 is the area BX.

In the area AX and the area BX, ink is jetted from both of the nozzles 21 and 22. The position of the area A1 is coincident with the position of the area B1 in the left-right direction. The same is true on the areas AX and BX and the areas A2 and B2.

In the following, the area AX of the head chip 11 is referred to as a boundary area AX, and the area BX of the head chip 12 is referred to as a boundary area BX. The nozzles 21 arranged in the area AX are referred to as boundary nozzles 21X and the nozzles 22 arranged in the area BX are referred to as boundary nozzles 22X. Information about the positions of the boundary nozzles 21X and 22X is stored in the ROM or the nonvolatile memory in the controller.

For sake of simplicity, in FIG. 4, from among the boundary nozzles 21X and 22X, the leftmost boundary nozzle 21X and the leftmost boundary nozzle 22X are referred to as a boundary nozzle 21L and a boundary nozzle 22L, respectively, and the rightmost boundary nozzle 21X and the rightmost boundary nozzle 22X are referred to as a boundary nozzle 21R and a boundary nozzle 22R, respectively.

Figure 5:
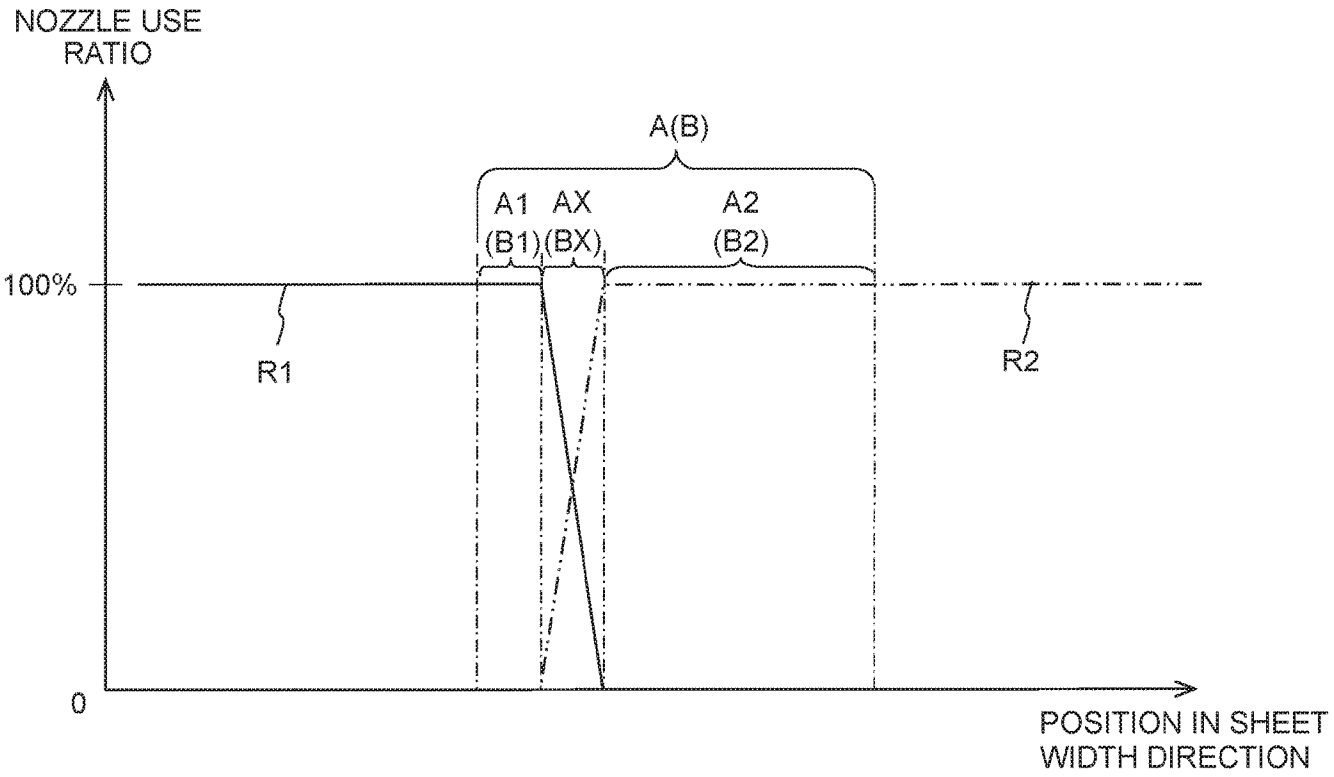
FIG. 5 is a graph indicating a nozzle use-ratio between two head chips.

FIG. 5 depicts changes in a use-ratio R1 of the nozzles 21 of the head chip 11 and a use-ratio R2 of the nozzles 22 of the head chip 12 depending on positions in the left-right direction. In this context, the use-ratio means a ratio of dots to be formed by nozzles of one of the head chips for dots to be formed in a predefined area of the recording medium.

For example, when 10 dots are formed in an area based on density data of each color ink that is obtained by image processing for image data including RGB data or the like, the nozzle use-ratio of the head chip 11 in that area may be 70%. In that case, seven dots of 10 dots are formed by the nozzles 21 of the head chip 11 and remaining three dots are formed by the nozzles 22 of the head chip 12.

In the above case, $0<R1<100\%$ is satisfied in the position of the boundary nozzles 21X, and $0<R2<100\%$ is satisfied in the position of the boundary nozzles 22X. The nozzles 21 arranged on the right of the boundary nozzle 21R are not used for printing, and the nozzles 22 arranged on the left of the boundary nozzle 22L are not used for printing.

Even when the above-described control is performed, an image part formed by the boundary nozzles 21X and 22X still has density unevenness, as compared to an image part formed by only the nozzles of a single head chip. Thus, when the positions of the boundary nozzles 21X and 22X in the left-right direction are the same between the four ink-jet heads 4, density unevenness caused by inks jetted from the boundary nozzles 21X and 22X of the respective four ink-jet heads 4 may overlap with each other, resulting in an increase in the density unevenness.

Figure 7:
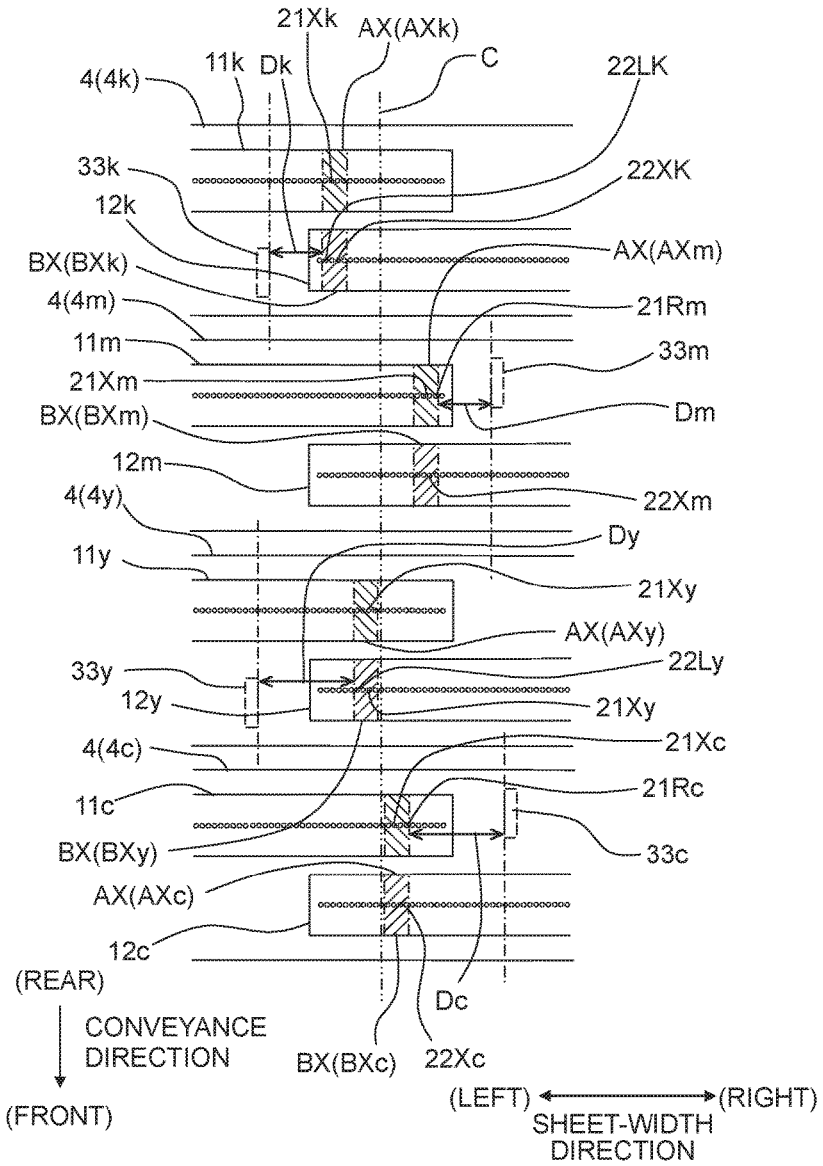
FIG. 7 is an enlarged view of FIG. 2.

Thus, as depicted in FIG. 7, the four ink-jet head 4 have mutually different positions of the boundary areas AX of the areas A and the boundary areas BX of the areas B. In the following, the positions, in the left-right direction, of the leftmost boundary area AX and the leftmost boundary area BX will be described specifically. As depicted in FIG. 7, a two-dot chain line that represents a center position in the left-right direction and is common between the areas A and B is referred to as a center line C.

A boundary area AXk of the head chip 11 and a boundary area BXk of the head chip 12 for black ink are positioned on the left of the center line C. Similarly, a boundary area AXy of the head chip 11 and a boundary area BXy of the head chip 12 for yellow ink are positioned on the left of the center line C. The boundary areas AXk and BXk are positioned on the left of the boundary areas AXy and BXy. Namely, a boundary nozzle 22Lk arranged on the leftmost position of the boundary nozzles 22Xk of the head chip 12*k* is positioned on the left of a boundary nozzle 22Ly arranged on the leftmost position of the boundary nozzles 22Xy of the head chip 12*y*.

Meanwhile, boundary areas AXm and BXm for magenta ink and boundary areas AXc and BXc for cyan ink are positioned on the right of the center line C. The boundary areas AXm and BXm are positioned on the right of the boundary areas AXc and BXc.

The distance between the center line C and the boundary area AXk for black ink is equal to the distance between the center line C and the boundary area AXm for magenta ink. The same is true on the boundary area BXk and the boundary area BXm. Further, the distance between the center line C and the boundary area AXy for yellow ink is equal to the distance between the center line C and the boundary area AXc for cyan ink. The same is true on the boundary area BXy and the boundary area BXc.

The boundary areas AXk and BXk and the boundary areas AXm and BXm are symmetrically arranged across the center line C, and the boundary areas AXy and BXy and the boundary areas AXc and BXc are symmetrically arranged across the center line C.

Although only the leftmost boundary areas AX and BX have been explained above, the same is true on other boundary areas.

<Roller Unit>

Subsequently, the roller unit 8 will be explained. As depicted in FIGS. 3 and 6, the roller unit 8 includes a frame 31 fixed to a body of the housing 2, and rollers 33, 34, and 35 attached to the frame 31.

The frame 31, of which outer circumference is a substantially rectangular shape as view from above, is long in the left-right direction and fixed to the housing 2. The frame 31 has four rectangular openings 36, and each of the ink-jet heads 4 is inserted into the corresponding one of the openings 36 from above.

Each of the rollers 33 to 35 has a gear shape and is rotatably supported by a support part 32. Each of the ink-jet heads 4 includes three rollers 33.

The rollers 33 to 35 are accommodated in the notches 16, each of which is formed by the above-described side surfaces 13, 14, and 15 and is provided at a lower part of the chip holding plate 10, in a state where the ink-jet heads 4 are inserted into the openings 36, respectively. The rollers 33 to 35 do not interfere with the ink-jet heads 4.

As depicted in FIG. 6, the rollers 33 to 35 press the recording sheet 100 being conveyed on the platen 3 from above. This prevents variation in a gap G between an ink jetting surface 17 of each head chip 11 or the like and the recording sheet 100, thus reducing an ink landing deviation.

As depicted in FIGS. 2 and 7, the four ink-jet heads 4*k*, 4*m*, 4*y*, and 4*c* corresponding to the inks of four colors are arranged. In the present embodiment, the four ink-jet heads are arranged in the order of black, magenta, yellow, and cyan from the rear side to the front side, i.e., in the order of KMYC.

<Layout for Roller>

Subsequently, a layout for the rollers 33 to 35 will be explained. At first, the rollers 33 arranged in the vicinities of the areas AX and BX of the head chips 11 and 12 will be explained. Although each of the ink-jet heads 4 includes the three rollers 33, a relation between the roller 33 and the head chip 11 adjacent to the roller 33 and a relation between the roller 33 and the head chip 12 adjacent to the roller 33 are common between the three rollers 33. Thus, the layout for the leftmost roller 33 will be explained as a representative.

The roller 33*k* for black ink is arranged on the left of the head chip 12*k* at a position facing the head chip 11*k* in the front-rear direction. Namely, the roller 33*k* is arranged on the left of the boundary areas AX and BX.

As with the roller 33*k*, the roller 33*y* for yellow ink is arranged on the left of the head chip 12*y* at a position facing the head chip 11*y* in the front-rear direction. Namely, the roller 33*y* is arranged on the left of the areas AX and BX. The roller 33*y* is arranged on the left of the roller 33*k*. Thus, the distance between the roller 33*k* and the head chip 12*k* adjacent to the roller 33*k* is smaller than the distance between the roller 33*y* and the head chip 12*y* adjacent to the roller 33*y*.

The roller 33*m* for magenta ink is arranged on the right of the head chip 11*m* at a position facing the head chip 12*m* in the front-rear direction. Namely, the roller 33*m* is arranged on the right of the boundary areas AX and BX. The roller 33*m* and the roller 33*k* are symmetrically arranged across the center line C for the areas A and B.

The roller 33*c* for cyan ink is arranged similarly as the roller 33*m*. The roller 33*c* is arranged on the right of the roller 33*m*. The roller 33*c* and the roller 33*y* are symmetrically arranged across the center line C for the areas A and B.

Subsequently, the roller 34 will be explained. As depicted in FIG. 3, the roller 34 is accommodated in a notch 16, of the notches 16 of the chip holding plate 10, including no roller 33. The roller 34 is provided to press the recording sheet 100 more reliably.

As depicted in FIG. 2, the roller 34*k* for black ink is arranged on the right of the rightmost head chip 11*k* at a position facing the head chip 12*k* in the front-rear direction. Namely, the roller 34*k* is arranged on the right of the rightmost roller 33*k* to press the vicinity of a right end of the recording sheet 100.

Similarly, the roller 34*y* for yellow ink is arranged on the right of the rightmost head chip 11i*y* at a position facing the head chip 12*y* in the front-rear direction.

The roller 34*m* for magenta ink is arranged on the left of the leftmost head chip 12*m* at a position facing the head chip 11*m* in the front-rear direction. The roller 34*m* presses the vicinity of a left end of the recording sheet 100. The roller 34*c* for cyan ink is arranged similarly.

The distance between the roller 34*k* and the rightmost head chip 11*k* in the left-right direction is longer than the distance between the roller 33*k* and the head chip 12*k* adjacent to the roller 33*k* in the left-right direction. Thus, the roller 34*k* presses a position closer to the vicinity of the right end of the recording sheet 100 than the roller 33*k*. Similarly, the distance between the roller 34*y* and the rightmost head chip 11*y* in the left-right direction is longer than the distance between the roller 33*y* and the head chip 12*k* adjacent to the roller 33*y* in the left-right direction.

The distance between the roller 34*m* and the leftmost head chip 12*m* in the left-right direction is longer than the distance between the roller 33*m* and the head chip 11*m* adjacent to the roller 33*m* in the left-right direction. Thus, the roller 34*m* presses a position closer to the vicinity of the left end of the recording sheet 100 than the roller 33*m*. The roller 34*c* is arranged similarly to the roller 34*m*.

The ink-jet heads 4 are arranged in the order of KMYC in the front-rear direction, and thus the rollers 34 are alternately arranged at the right ends and left ends of the ink-jet heads 4. This allows the rollers 34 to press the right end and left end of the recording sheet 100 in a balanced manner Subsequently, rollers 35 will be explained. A roller 35*k* for black ink is arranged on the left of the leftmost roller 33*k* at a position facing the leftmost head chip 11*k* in the front-rear direction. Namely, the roller 35*k* is arranged on the outside of the leftmost roller 33*k* in the left-right direction to press the vicinity of the left end of the recording sheet 100.

Similarly, a roller 35*y* for yellow ink is arranged on the left of the leftmost roller 33*y* at a position facing the leftmost head chip 11*y* in the front-rear direction.

A roller 35*m* for magenta ink is arranged on the right of the rightmost roller 33*m* at a position facing the rightmost head chip 12*m* in the front-rear direction. Namely, the roller 35*m* is arranged on the outside of the rightmost roller 33*m* in the left-right direction to press the vicinity of the right end of the recording sheet 100. A roller 35*c* for cyan ink is similarly arranged.

The position of the roller 35*k* in the left-right direction is different from the position of the roller 35*y* in the left-right direction. The same is true on the roller 35*m* and the roller 35*c*. Accordingly, roller marks are reduced.

<Positional Relation between Roller and Boundary Nozzles>

Subsequently, a positional relation between the roller 33 and the boundary areas AX and BX of the two head chips 11 and 12 will be described. In the present embodiment, the ink-jet head 4 for black ink, from among the inks of four colors including black, yellow, cyan, and magenta, having conspicuous density unevenness easily is configured such that the roller 33 is positioned close to the boundary areas AX and BX.

In particular, the distance between the roller 33 for each of the black and magenta inks and the boundary nozzles 21X and 22X is preferentially reduced. Since black and magenta inks jetted from the boundary nozzles 21X and 22X easily have conspicuous density unevenness, gap variation during printing is required to be reduced by providing the rollers 33 for black and magenta inks at positions closer to the boundary nozzles 21X and 22X. Yellow and cyan inks are not likely to have conspicuous density unevenness, and thus the distance between the roller 33 for each of the yellow and cyan inks and the boundary nozzles 21X and 22X may be relatively long.

On the basis of the above, the positional relation between the roller 33 and the boundary nozzles 21X and 22X will be described. At first, the roller 33*k* and the boundary nozzles 21Xk and 22Xk for black ink are on the left of the center line C for the areas A and B. The distance, in the left-right direction, between the roller 33*k* and the leftmost boundary nozzle 22 LK of the boundary nozzles 22Xk is referred to as a distance Dk.

The roller 33*y* and the boundary nozzles 21Xy and 22Xy for yellow ink are positioned on the left of the center line C. The distance, in the left-right direction, between the roller 33*y* and the leftmost boundary nozzle 22Ly of the boundary nozzles 22Xy is referred to as a distance Dy. As described above, the roller 33*k* is arranged on the right of the roller 33*y*, and the boundary nozzle 22Lk is arranged on the left of the boundary nozzle 22Ly. Thus, the distance Dk is shorter than the distance Dy.

In the present embodiment, since the density unevenness of black ink is more conspicuous than the density unevenness of yellow ink, the distance Dk is preferentially reduced. The density unevenness of yellow ink is not likely to be conspicuous, and thus making the distance Dy slightly long hardly affects image quality.

The roller 33*m* and the boundary nozzles 21Xm and 22Xm for magenta ink are positioned on the right of the center line C. The distance, in the left-right direction, between the roller 33*m* and the rightmost boundary nozzle 21Rm of the boundary nozzles 21Xm is referred to as a distance Dm. As described above, the rollers 33*k* and the rollers 33*m* are symmetrically arranged across the center line C, and the same is true on the boundary areas AXk, BXk and the boundary areas AXm, BXm. Thus, the distance Dk is equal to the distance Dm. Namely, the distance Dm is shorter than the distance Dy.

The roller 33*c* and the boundary nozzles 21Xc and 22Xc for cyan ink are positioned on the right of the center line C. The distance, in the left-right direction, between the roller 33*c* and the rightmost boundary nozzle 21Rc of the boundary nozzles 21Xc is referred to as a distance Dc. As described above, the roller 33*m* is arranged on the left of the roller 33*c*, and the boundary nozzle 21Xm is arranged on the right of the boundary nozzle 21Xc. Thus, the distance Dm is shorter than the distance Dc. As with the case of black and yellow inks, since the density unevenness of magenta ink is more conspicuous than the density unevenness of cyan ink, the distance Dm is preferentially reduced.

In the above configuration, the positions of the rollers 33 in the left-right direction are different between the ink-jet heads 4 for the respective four color inks. Thus, roller marks are made at mutually different positions between the ink-jet heads 4, which makes the roller marks inconspicuous. Further, in the above configuration, the positions of the boundary nozzles 21X and 22X in the left-right direction are different between the ink-jet heads 4 for the respective four color inks. Thus, density unevenness occurs at various positions, which prevents deterioration of image quality.

The variation in the gap G may be reduced by arranging each roller 33 as close to the boundary nozzles 21X and 22X as possible. However, it is difficult to reduce the distance between each roller 33 and the boundary nozzles 21X and 22X for all of the ink-jet heads 4. Thus, in the present embodiment, black ink of which density unevenness is most likely to be conspicuous has a reduced distance.

The roller 33 may be arranged at a position that is symmetrical with the roller 33*k* for black ink in the left-right direction about the center line C for the areas A and B. In the present embodiment, the roller 33*m* for magenta ink that may have the second most conspicuous density unevenness is arranged at a position close to the boundary nozzles 21Xm and 22Xm.

The distance Dk for black ink may be equal to the distance Dm for magenta ink, provided that each roller 33 is arranged as close to the boundary nozzles 21X and 22X as possible.

Yellow ink is not likely to have conspicuous density unevenness. Thus, even when the roller 33*y* is slightly distant from the boundary nozzles 21Xy and 22Xy to cause variation in the gap G, the effect on image quality is smaller than those of the black and magenta inks. The same is true on cyan ink.

The rollers 34 are arranged in the notches 16 in which no rollers 33 are accommodated, and thus deterioration in image quality caused by gap variation during printing is further prevented.

The arrangement order of the ink-jet heads 4 allows the rollers 34 to be arranged zigzag, and thus gap variation is further effectively prevented in the vicinities of ends of the recording sheet 100 in the left-right direction.

The rollers 35 are arranged on the outsides of the rollers 33, and thus gap variation is further effectively prevented in the vicinities of ends of the recording sheet 100 in the left-right direction.

In the above-described embodiment, the front-rear direction corresponds to "first direction" of the present teaching; the left-right direction corresponds to "second direction" of the present teaching; the recording sheet 100 corresponds to "recording medium" of the present teaching; the head chip 11*k* corresponds to "first head chip" of the present teaching; the head chip 12*k* corresponds to "second head chip" of the present teaching; the head chip 11*y* corresponds to "third head chip" of the present teaching; the head chip 12*y* corresponds to "fourth head chip" of the present teaching; the head chip 11*m* corresponds to "fifth head chip" of the present teaching; and the head chip 12*m* corresponds to "sixth head chip" of the present teaching.

The roller 33*k* corresponds to "first roller" of the present teaching; the roller 33*y* corresponds to "second roller" of the present teaching; the roller 33*m* corresponds to "third roller" of the present teaching; the roller 34*k* corresponds to "first auxiliary roller" of the present teaching; the roller 34*y* corresponds to "second auxiliary roller" of the present teaching; the roller 34*m* corresponds to "third auxiliary roller" of the present teaching; the roller 35*k* corresponds to "fourth auxiliary roller" of the present teaching; the roller 35*y* corresponds to "fifth auxiliary roller" of the present teaching; the boundary nozzle 22Lk corresponds to "nozzle A" of the present teaching; and the boundary nozzle 22Ly corresponds to "nozzle B" of the present teaching.

In the embodiment, the positions of the head chips 11 and 12 in the left-right direction are the same between the ink-jet heads 4. The present teaching, however, is not limited thereto.

In the embodiment, each of the ink-jet heads 4 includes two head chips 11 and two head chips 12, the number of head chips 11 and 12 is not limited two, and each of the ink-jet heads 4 may include any number of the head chips 11 and 12.

Instead of the rollers 33, 34, and 35, for example, circular rubber rollers having a smooth outer circumferential surface may be used, provided that they may function as rollers pressing the recording sheet 100. Further, instead of the rollers, the structure by which the recording sheet 100 is pressed may be a structure, such as a protrusion, protruding on a platen side beyond the nozzle surface and having a smooth surface in which an end that may make contact with the recording sheet is chamfered.

Subsequently, modified embodiments in which modifications are added to the embodiment will be described. The components or parts which are the same as those of the above embodiment are designated by the same reference numerals, and any explanation thereof will be omitted as appropriate.

<First Modified Embodiment>

Figure 8:
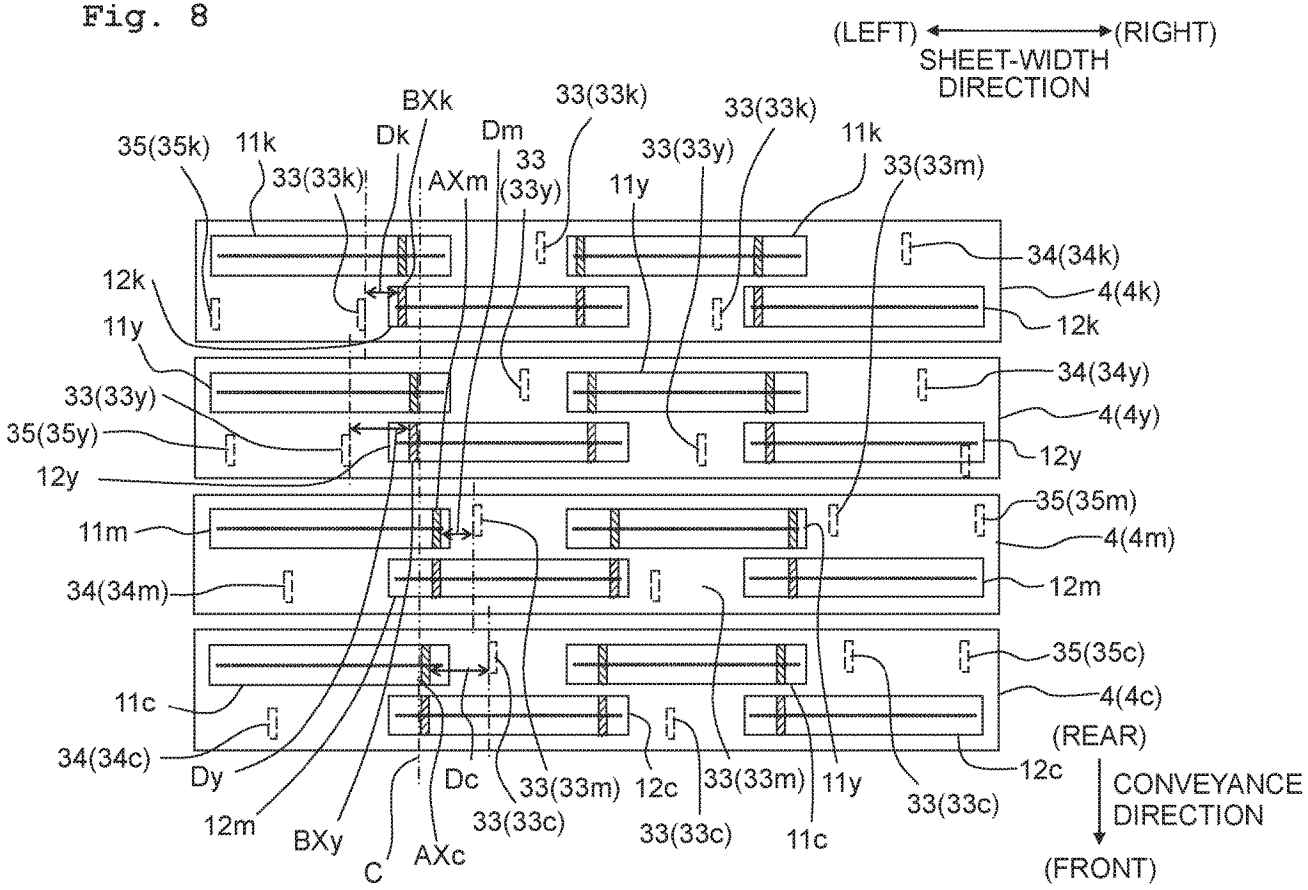
FIG. 8 is a plan view of another arrangement of the four ink-jet heads.

As depicted in FIG. 8, the ink-jet heads 4 are arranged in the order of KYMC from the rear side to the front side. In such a configuration, the positions of the rollers 33 in the left-right direction are different from each other, and thus the recording sheet 100 may have inconspicuous roller marks. Further, the positions of the boundary areas AX and BX in the left-right direction are different between the ink-jet heads 4, and thus an image to be formed may have inconspicuous density unevenness. The positional relations between the rollers 33 and the boundary nozzles 22X and 22X in the left-right direction for respective inks according to the first modified embodiment are the same as those of the above embodiment, the ink easily having conspicuous density unevenness may have a preferentially reduced distance between each roller 33 and the boundary nozzles 22X and 22X in the left-right direction.

<Second Modified Embodiment>

The distance between the roller 33 and one end of the head chip 11 or head chip 12 in the left-right direction is preferably the same as the distance between the roller 33 and the other end of the head chip 11 or head chip 12 in the left-right direction. Such a configuration, however, may not be obtained in some cases.

Figure 9:
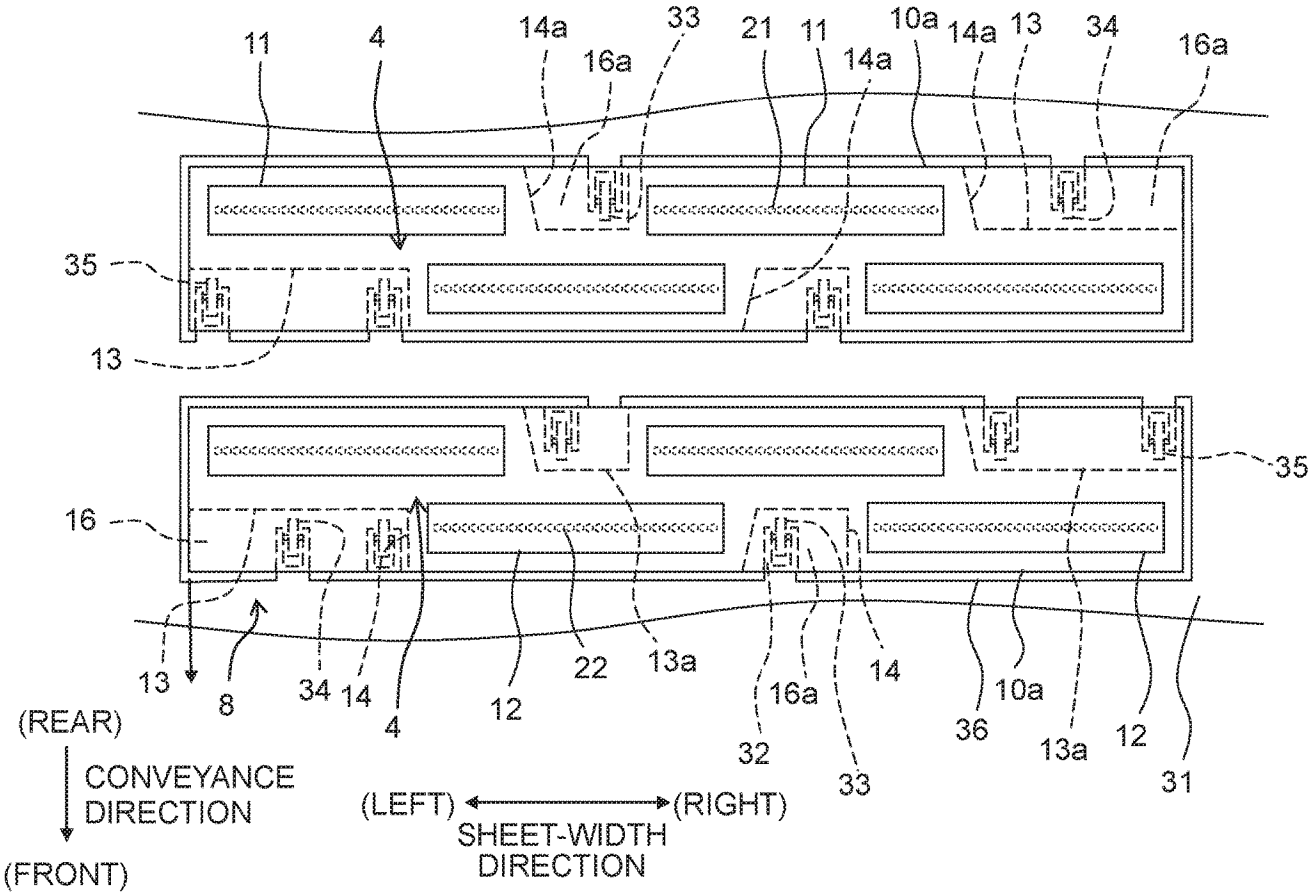
FIG. 9 is a schematic plan view of two ink-jet heads and roller units according to a second modified embodiment.

For example, as depicted in FIG. 9, each of the chip holding plates 10*a* includes a notch 16 and three notches 16*a*. Only the notch 16 arranged on the leftmost side is formed in a substantially rectangular parallelepiped space. Each of the notches 16*a* has an inclined surface rather than the substantially rectangular parallelepiped shape. Namely, unlike each side surface 14 orthogonal to the left-right direction, each side surface 14*a* forming the corresponding notch 16*a* is inclined in the left-right direction. Such a configuration may be adopted to improve maintenability as described, for example, in Japanese Patent Application laid open No. 2015-231721.

In the above case, the distance between the right end of the leftmost head chip 11 and the inclined side surface 14*a* is longer than a case in which the side surface is not inclined. Thus, it is difficult for the above case to make the distance between the roller 33*m* and the boundary nozzle 21Rm for magenta ink and the distance between the roller 33*k* and the boundary nozzle 22Lk for black ink equal.

Even when the side surface 14*a* is not inclined, the roller 33*m* may have difficulty in being provided close to the head chip 11*m* for some reasons, for example, a temperature sensor needs to be attached to the side surface 14*a*.

Figure 10:
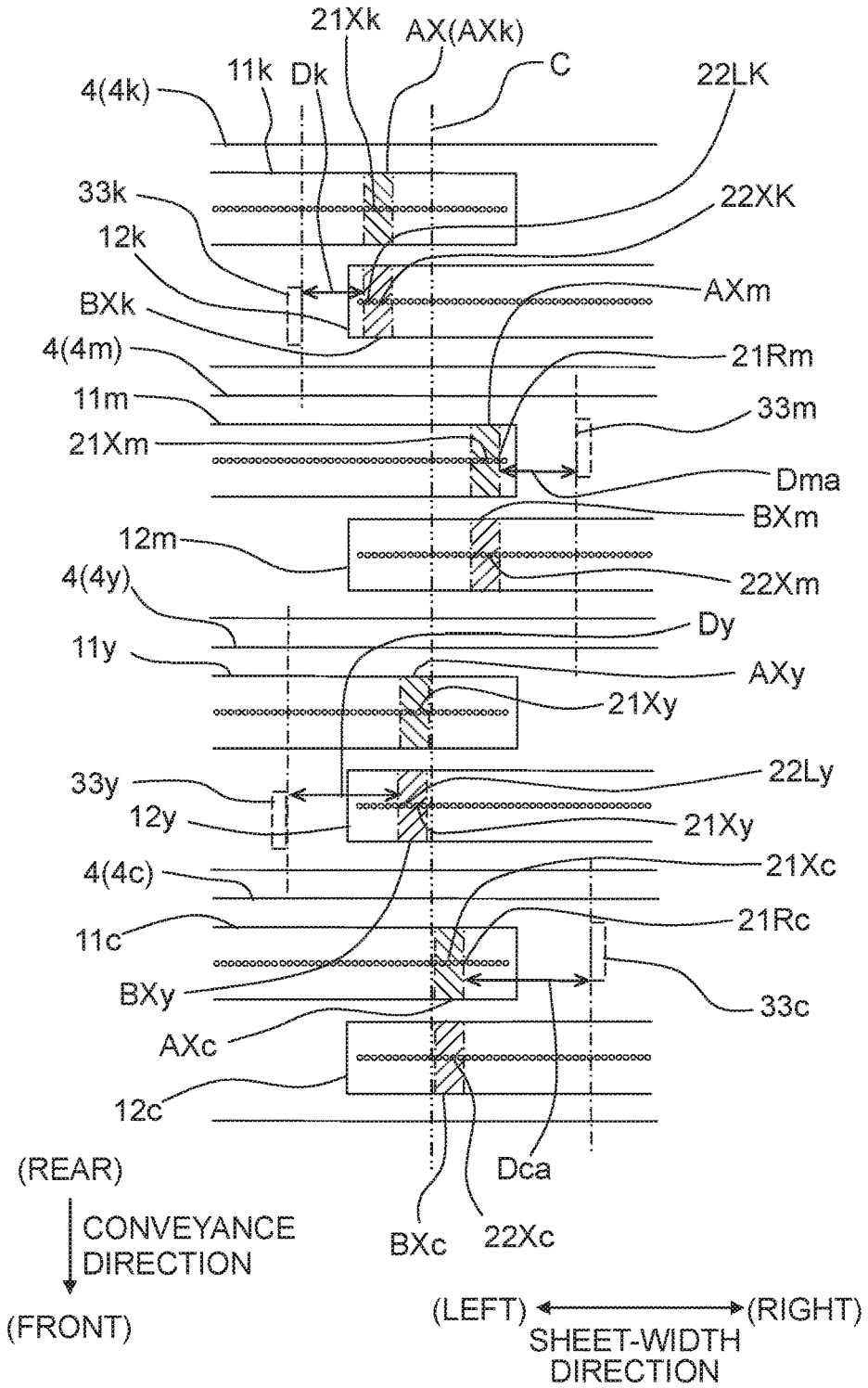
FIG. 10 is an enlarged plan view of four ink-jet heads according to the second modified embodiment.

Thus, as depicted in FIG. 10, the roller 33*m* for magenta ink is arranged at a position that is on the right of the position of the roller 33*m* in the above embodiment. Namely, the distance between the head chip 21*m* and the roller 33 in the left-right direction is greater than the distance between the head chip 22*k* and the roller 33*k*. Further, the roller 33*c* for cyan ink is arranged at position that is on the right of the position of the roller 33*c* in the above embodiment, and the position of the roller 33*c* is different from the position of the roller 33*m* in the left-right direction. The distance between the head chip 21*m* and the roller 33*m* in the left-right direction is smaller than the distance between the head chip 22*y* and the roller 33*y* for yellow ink.

Thus, a distance Dma between the roller 33*m* and the boundary nozzle 21Rm is greater than the distance Dk between the roller 33*k* and the boundary nozzle 22Lk. In that configuration, making the distance Dma longer is allowed to prevent density unevenness of black ink preferentially. Similarly, making a distance Dca between the roller 33*c* and the boundary nozzle 21Rc longer is allowed. Density unevenness of magenta ink, however, is more conspicuous than yellow and cyan inks, and thus it needs to be reduced. In view of this, the distance Dma is smaller than the distance Dca and the distance Dy between the roller 33*y* and the boundary nozzle 22Ly.

<Third Modified Embodiment>

In areas AX and BX of head chips 11 and 12 of a third modified embodiment, ink is not jetted from both of the head chips 11 and 12. Instead, use nozzles of the head chips 11 and 12 are used selectively at boundaries in the left-right direction. In that case, no boundary nozzles 21X and 22X are present. The rightmost nozzle 21 of nozzles 21 to be used for printing is the boundary nozzle 21R and the leftmost nozzle 22 of nozzles 22 to be used for printing is the boundary nozzle 22L.

<Fourth Modified Embodiments>

In the above embodiment and modified embodiments, magenta, yellow, and cyan inks jetted from the respective ink-jet heads 4 may be replaced with each other. Inks having any other colors than black, magenta, yellow, and cyan may be used. The number of the ink-jet heads 4 is not limited to four. For example, three ink-jet head heads 4 may be provided to jet magenta, yellow, and cyan inks respectively.

What is claimed is:

1. A printer configured to perform printing on a recording medium, comprising:

first nozzle groups corresponding to a first ink and arrayed at intervals in a second direction orthogonal to a first direction;

second nozzle groups corresponding to the first ink and arrayed at intervals in the second direction at positions which are different from arrangement positions of the first nozzle groups in the second direction and are adjacent to arrangement positions of the first nozzle groups in the first direction;

third nozzle groups corresponding to a second ink and arrayed at intervals in the second direction at positions respectively corresponding to the arrangement positions of the first nozzle groups in the second direction;

fourth nozzle groups corresponding to the second ink and arrayed at intervals in the second direction at positions which respectively correspond to arrangement positions of the second nozzle groups in the second direction and are adjacent to arrangement positions of the third nozzle groups in the first direction;

a first roller arranged to face one of the first nozzle groups in the first direction on one side of a second nozzle group N in the second direction, the second nozzle group N being a N-th second nozzle group of the second nozzle groups counted from the one side in the second direction; and a second roller arranged to face one of the third nozzle groups in the first direction on one side of a fourth nozzle group N in the second direction, the fourth nozzle group N being an N-th fourth nozzle group of the fourth nozzle groups counted from the one side in the second direction, wherein a nozzle A is arranged closer to the one side in the second direction than a nozzle B and the first roller is arranged closer to the other side in the second direction than the second roller, the nozzle A being a nozzle, of nozzles arranged in the second nozzle group N and used for printing, which is positioned closest to the one side in the second direction, and the nozzle B being a nozzle, of nozzles arranged in the fourth nozzle group N and used for printing, which is positioned closest to the one side in the second direction.

2. The printer according to claim 1, further comprising:

fifth nozzle groups corresponding to a third ink and arrayed at intervals in the second direction at positions respectively corresponding to the arrangement positions of the first nozzle groups in the second direction;

sixth nozzle groups corresponding to the third ink and arrayed at intervals in the second direction at positions which respectively correspond to the arrangement positions of the second nozzle groups in the second direction and are adjacent to arrangement positions of the fifth nozzle groups in the first direction; and a third roller arranged to face one of the sixth nozzle groups in the first direction on the other side of a fifth nozzle group N in the second direction, the fifth nozzle group N being an N-th fifth nozzle group of the fifth nozzle groups counted from the one side in the second direction, wherein a distance between the fifth nozzle group N and the third roller in the second direction is shorter than a distance between the fourth nozzle group N and the second roller in the second direction.

3. The printer according to claim 2, wherein a distance between the second nozzle group N and the first roller in the second direction is identical to the distance between the fifth nozzle group N and the third roller in the second direction.

4. The printer according to claim 2, wherein the distance between the fifth nozzle group N and the third roller in the second direction is longer than a distance between the second nozzle group N and the first roller in the second direction.

5. The printer according to claim 2, further comprising:

a first auxiliary roller arranged to face one of the second nozzle groups in the first direction at a position closer to the other side in the second direction than a first nozzle group E which is a first nozzle group, of the first nozzle groups, arranged closest to the other side in the second direction;

a second auxiliary roller arranged to face one of the fourth nozzle groups in the first direction at a position closer to the other side in the second direction than a third nozzle group E which is a third nozzle group, of the third nozzle groups, arranged closest to the other side in the second direction; and a third auxiliary roller arranged to face one of the fifth nozzle groups in the first direction at a position closer to the one side in the second direction than a sixth nozzle group E which is a sixth nozzle group, of the sixth nozzle groups, arranged closest to the one side in the second direction, wherein a distance between the second nozzle group N and the first roller in the second direction is shorter than a distance between the first nozzle group E and the first auxiliary roller in the second direction, the distance between the fourth nozzle group N and the second roller in the second direction is shorter than a distance between the third nozzle group E and the second auxiliary roller in the second direction, and the distance between the fifth nozzle group N and the third roller in the second direction is shorter than a distance between the sixth nozzle group E and the third auxiliary roller in the second direction.

6. The printer according to claim 5, wherein the fifth nozzle groups and the sixth nozzle groups are arranged between the first and second nozzle groups and the third and fourth nozzle groups in the first direction, and the third auxiliary roller is arranged between the first auxiliary roller and the second auxiliary roller in the first direction.

7. The printer according to claim 1, further comprising:

a fourth auxiliary roller arranged to face one of the first nozzle groups in the first direction at a position closer to the one side in the second direction than a first roller, of the first rollers, arranged closest to the one side in the second direction; and a fifth auxiliary roller arranged to face one of the third nozzle groups in the first direction at a position closer to the one side in the second direction than a second roller, of the second rollers, arranged closest to the one side in the second direction;

wherein the position of the fourth auxiliary roller in the second direction is different from the position of the fifth auxiliary roller in the second direction.

8. The printer according to claim 1, wherein the first ink is a black ink and the second ink is one of a magenta ink, a yellow ink, and a cyan ink.

9. The printer according to claim 1, wherein the first ink is a magenta ink and the second ink is a yellow ink or a cyan ink.

10. The printer according to claim 2, wherein the first ink is a black ink, the second ink is a yellow ink or a cyan ink, and the third ink is a magenta ink.

11. A printer configured to perform printing on a recording medium, comprising:

a first nozzle group corresponding to a first ink and formed with nozzles which are arrayed in a second direction orthogonal to a first direction;

a second nozzle group corresponding to the first ink, formed with nozzles arrayed in the second direction, and arranged at a position which is different from an arrangement position of the first nozzle group in the second direction and is adjacent to an arrangement position of the first nozzle group in the first direction;

a third nozzle group corresponding to a second ink, formed with nozzles arrayed in the second direction, and arranged at a position which corresponds to the arrangement position of the first nozzle group in the second direction;

a fourth nozzle group corresponding to the second ink, formed with nozzles arrayed in the second direction, and arranged at a position which corresponds to an arrangement position of the second nozzle group in the second direction and is adjacent to an arrangement position of the third nozzle group in the first direction;

a first roller arranged to face the first nozzle group in the first direction on one side of the second nozzle group in the second direction; and a second roller arranged to face the third nozzle group in the first direction on one side of the fourth nozzle group in the second direction, wherein a nozzle A is arranged closer to the one side in the second direction than a nozzle B and the first roller is arranged closer to the other side in the second direction than the second roller, the nozzle A being a nozzle, of nozzles arranged in the second nozzle group and used for printing, which is positioned closest to the one side in the second direction, and the nozzle B being a nozzle, of nozzles arranged in the fourth nozzle group and used for printing, which is positioned closest to the one side in the second direction.

12. A printer comprising:

a first nozzle group corresponding to a first ink and formed with nozzles which are arrayed in a second direction orthogonal to a first direction;

a second nozzle group corresponding to the first ink, formed with nozzles arrayed in the second direction, and arranged at a position which is different from an arrangement position of the first nozzle group in the second direction and is adjacent to an arrangement position of the first nozzle group in the first direction;

a third nozzle group corresponding to a second ink, formed with nozzles arrayed in the second direction, and arranged at a position which corresponds to the arrangement position of the first nozzle group in the second direction;

a fourth nozzle group corresponding to the second ink, formed with nozzles arrayed in the second direction, and arranged at a position which corresponds to an arrangement position of the second nozzle group in the second direction and is adjacent to an arrangement position of the third nozzle group in the first direction;

a first pressing part configured to press the recording medium and arranged to face the first nozzle group in the first direction on one side of the second nozzle group in the second direction; and a second pressing part configured to press the recording medium and arranged to face the third nozzle group in the first direction on one side of the fourth nozzle group in the second direction, wherein a nozzle A is arranged closer to the one side in the second direction than a nozzle B and the first pressing part is arranged closer to the other side in the second direction than the second pressing part, the nozzle A being a nozzle, of nozzles arranged in the second nozzle group and used for printing, which is positioned closest to the one side in the second direction, and a nozzle B being a nozzle, of nozzles arranged in the fourth nozzle group and used for printing, which is positioned closest to the one side in the second direction.

* * * * *